US008177622B2

(12) United States Patent
Englman

(10) Patent No.: US 8,177,622 B2
(45) Date of Patent: May 15, 2012

(54) WAGERING GAME WITH BACKGROUND MODIFICATION FEATURE

(75) Inventor: Allon G Englman, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1246 days.

(21) Appl. No.: 11/793,569

(22) PCT Filed: Dec. 6, 2005

(86) PCT No.: PCT/US2005/044352

§ 371 (c)(1),
(2), (4) Date: Jun. 20, 2007

(87) PCT Pub. No.: WO2006/068844

PCT Pub. Date: Jun. 29, 2006

(65) Prior Publication Data

US 2008/0032784 A1 Feb. 7, 2008

Related U.S. Application Data

(60) Provisional application No. 60/637,600, filed on Dec. 20, 2004.

(51) Int. Cl.
*A63F 9/24* (2006.01)

(52) U.S. Cl. ..... 463/20; 463/16; 463/31

(58) Field of Classification Search ..... 463/16, 463/20, 21, 25, 31, 30, 32, 33, 34
See application file for complete search history.

(56) References Cited

U.S. PATENT DOCUMENTS

| | | | | |
|---|---|---|---|---|
| 5,766,074 | A * | 6/1998 | Cannon et al. | 463/16 |
| 5,890,962 | A * | 4/1999 | Takemoto | 463/20 |
| 6,251,013 | B1 * | 6/2001 | Bennett | 463/13 |
| 6,311,976 | B1 | 11/2001 | Yoseloff | |
| 6,319,124 | B1 | 11/2001 | Baerlocher et al. | |
| 6,419,579 | B1 * | 7/2002 | Bennett | 463/20 |
| 6,439,993 | B1 * | 8/2002 | O'Halloran | 463/16 |
| 6,517,432 | B1 * | 2/2003 | Jaffe | 463/16 |
| 6,604,740 | B1 | 8/2003 | Singer | |
| 6,805,632 | B2 | 10/2004 | Suda | |
| 7,354,342 | B2 * | 4/2008 | Paulsen et al. | 463/16 |
| 2002/0032050 | A1 * | 3/2002 | Baerlocher et al. | 463/20 |
| 2002/0052233 | A1 * | 5/2002 | Gauselmann | 463/20 |
| 2003/0013517 | A1 * | 1/2003 | Bennett et al. | 463/25 |
| 2003/0064779 | A1 * | 4/2003 | Suda | 463/20 |
| 2003/0100357 | A1 * | 5/2003 | Walker et al. | 463/16 |
| 2003/0157981 | A1 * | 8/2003 | Marks et al. | 463/20 |
| 2003/0190947 | A1 * | 10/2003 | Baerlocher et al. | 463/20 |

* cited by examiner

*Primary Examiner* — David L Lewis
*Assistant Examiner* — Chase Leichliter
(74) *Attorney, Agent, or Firm* — Nixon Peabody LLP

(57) ABSTRACT

A method of playing a wagering game. The method includes conducting the wagering game at a gaming terminal. A plurality of symbols is displayed, each of the plurality of symbols located in a cell of an array. In response to at least one of the plurality of symbols achieving a winning outcome, a player is awarded a winning award and a background of a cell associated with the winning outcome is modified. Also, the modification of the background causes an alteration in the wagering game.

20 Claims, 10 Drawing Sheets

WAGERING GAME WITH BACKGROUND MODIFICATION FEATURE

CROSS REFERENCE TO RELATED APPLICATIONS

This application is a U.S. national phase of International Application No. PCT/US2005/044352, filed Dec. 6, 2005 which claims the benefit of priority of U.S. Provisional Patent Application No. 60/637,600, filed Dec. 20, 2004, all of which are incorporated by reference in their entirety.

FIELD OF THE INVENTION

The present invention relates generally to gaming terminals for playing a wagering game and, more particularly, to a wagering game having a unique feature for allowing a player to achieve credits.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been employed is the use of a progressive jackpot. In the gaming industry, a "progressive" involves collecting coin-in data from participating gaming device(s) (e.g., slot machines), contributing a percentage of that coin-in data to a jackpot amount, and awarding that jackpot amount to a player upon the occurrence of a certain jackpot-won event. The percentage of the coin-in is determined prior to any result being achieved and is independent of any result. A jackpot-won event typically occurs when a "progressive winning position" is achieved at a participating gaming device. If the gaming device is a slot machine, a progressive winning position may, for example, correspond to alignment of progressive jackpot reel symbols along a certain pay line. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

Another concept that has been successfully employed to enhance the entertainment value of a game is that of a "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

However, in some of the basic games, the player is not as engaged as he/she could be because once the player wins an award, the basic game is finished, and there are no continuing benefits for having achieved a winning outcome.

Thus, there is a need to allow a player to play a wagering game in which there is a lasting effect to obtaining a winning combination.

SUMMARY OF THE INVENTION

According to one embodiment of the present invention, a method of playing a wagering game is provided. The method includes conducting the wagering game at a gaming terminal and displaying a plurality of symbols. Each of the plurality of symbols is located in a cell of an array. In response to at least one of the plurality of symbols achieving a winning outcome, a player is awarded a winning award and a background of a cell associated with the winning outcome is modified. The modification of the background causes an alteration in the wagering game.

In another embodiment of the present invention, a method of playing a wagering game is provided. The method includes conducting the wagering game at a gaming terminal and portraying an array of symbols at respective positions in the array. The array includes a plurality of cells. In response to a winning outcome, a player is awarded a winning award and a background of at least one of the plurality of cells associated with the winning outcome is modified. The method further includes maintaining the modification of the background for a predetermined period. The modification alters subsequent wagering games played during the predetermined period.

In yet another embodiment, a gaming terminal for playing a wagering game includes an input device for receiving inputs from a player during the wagering game. The inputs including a wager amount. A display for displaying a plurality of symbols of the wagering game in response to receiving the wager amount from the player is also included. Each of the plurality of symbols is located in a cell of an array, wherein, in response to a winning outcome being achieved, an award is awarded to the player. Also, a cell associated with the winning outcome is modified, such that the modification of the cell causes a game alteration.

In another embodiment, a gaming terminal comprising a wagering game is provided. The wagering game has a plurality of symbols arranged in a plurality of cells in an array. The plurality of symbols indicating a randomly selected outcome of the wagering game. In response to the randomly selected outcome being a winning outcome, the gaming terminal awards a player a winning award and modifies at least one of the plurality of cells for a predetermined period. The modification causes an alteration to occur during a subsequent wagering game played during the predetermined period.

In yet another embodiment of the present invention, a gaming system is provided. At least one display and at least one gaming terminal for playing a wagering game having a randomly selected outcome comprising a plurality of symbols is provided in the gaming system. The plurality of symbols are arranged in an array on the at least one display. The system also includes a controller coupled to the at least one gaming terminal and the at least one display. The controller is operative to award a player an award and modify at least a portion of the array on the at least one display in response to the randomly selected outcome including a winning outcome. In response to the modification, the controller also alters an outcome of at least one of a current wagering game or a subsequent wagering game.

The above summary of the present invention is not intended to represent each embodiment or every aspect of the present invention, as there are several novel methods and gaming terminals incorporating this communication feature. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
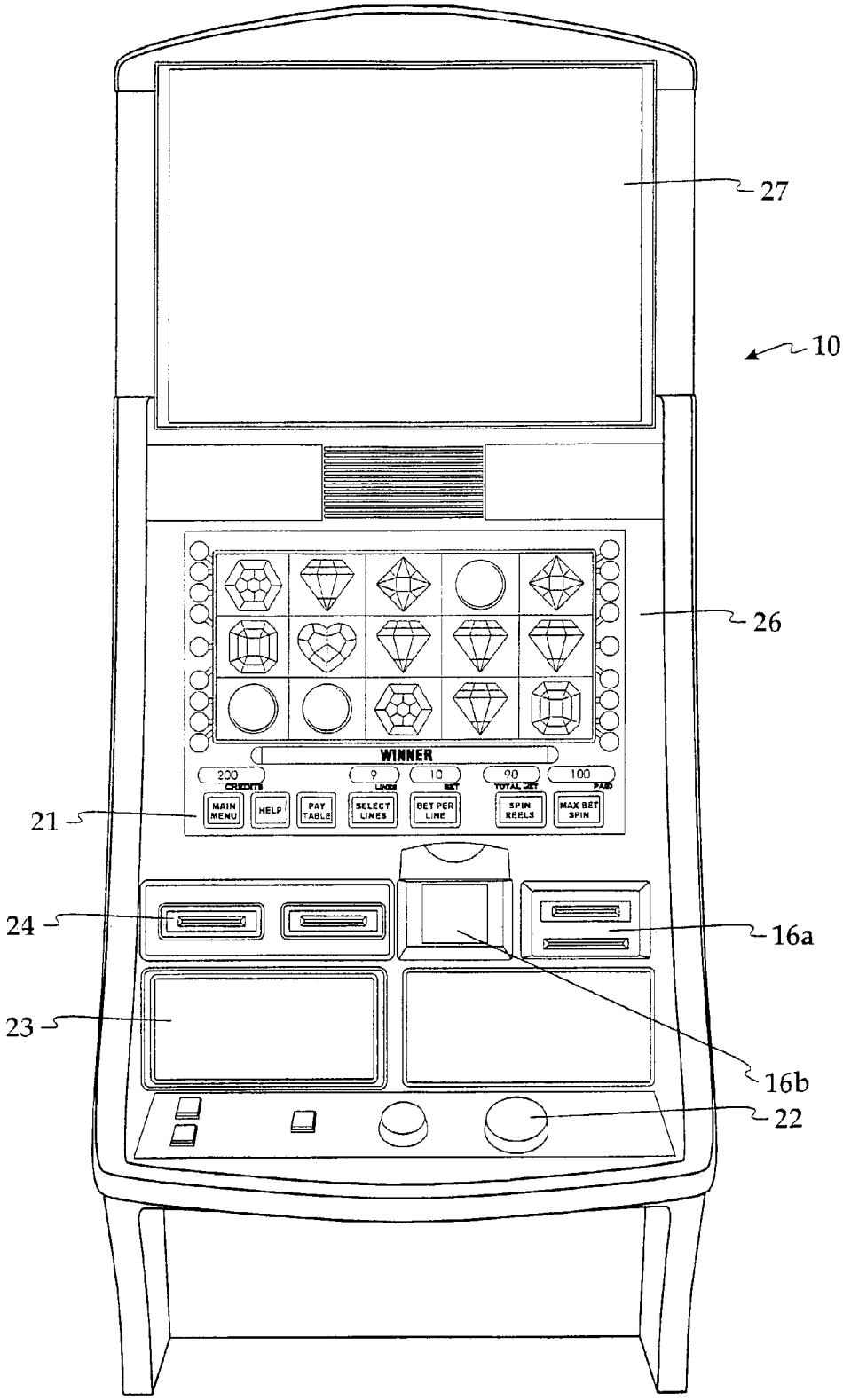
FIG. 1 is a perspective view of a video gaming terminal according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a perspective view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play video slots or a video casino game, such as blackjack, slots, keno, poker, etc.

As shown, the gaming terminal 10 includes input devices, such as a wager acceptor 16 (shown as a card wager acceptor 16*a* and a cash wager acceptor 16*b*), a touch screen 21, a push-button panel 22, and an information reader 24. For outputs, the gaming terminal 10 includes a payout mechanism 23, a main display 26 for displaying information about the basic wagering game, and a secondary display 27 that may display an electronic version of a pay table, and/or also possibly game-related information or other entertainment features. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The cash wager acceptor 16*a* may include a coin slot acceptor or a note acceptor to input value to the gaming terminal 10. The card wager acceptor 16*b* may include a card-reading device for reading a card that has a recorded monetary value with which it is associated. The card wager acceptor 16*b* may also receive a card that authorizes access to a central account, which can transfer money to the gaming terminal 10.

Also included is the payout mechanism 23, which performs the reverse functions of the wager acceptor 16. For example, the payout mechanism 23 may include a coin dispenser or a note dispenser to output value from gaming terminal 10. Also, the payout mechanism 23 may also be adapted to receive a card that authorizes the gaming terminal to transfer credits from the gaming terminal 10 to a central account.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The outcome of the basic wagering game is displayed to the player on the main display 26. The main display 26 may take the form of a cathode ray tube (CRT), a high resolution LCD, a plasma display, LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome, as well.

In some embodiments, the information reader 24 is a card reader that allows for identification of a player by reading a card with information indicating his or her true identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10. The information reader 24 may also include a keypad (not shown) for entering a personal identification number (PIN). The gaming terminal 10 may require that the player enter their PIN prior to obtaining information. The gaming terminal 10 may use the secondary display 27 for providing the player with information about his or her account or other player-specific information. Also, in some embodiments, the information reader 24 may be used to restore assets that the player achieved during a previous game session and had saved.

Figure 2:
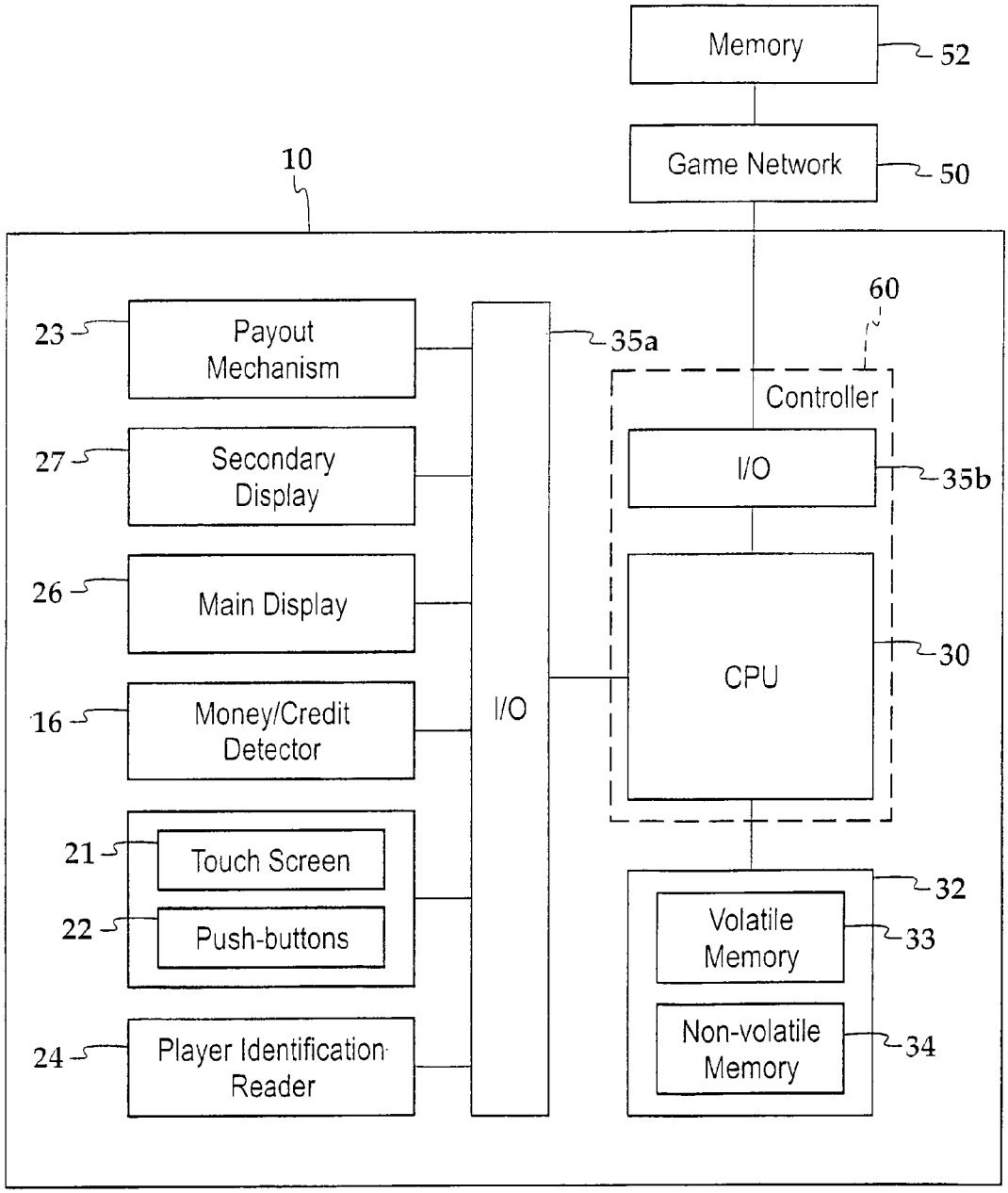
FIG. 2 is a block diagram of the gaming terminal of FIG. 1.

As shown in FIG. 2, the various components of the gaming terminal 10 are controlled by a central processing unit (CPU) 30 (such as a microprocessor or microcontroller). To provide the gaming functions, the CPU 30 executes a game program that allows for the randomly selected outcome. The CPU 30 is also coupled to or includes a local memory 32. The local memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the local memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 50 having control circuitry and memory devices. The game control network 50 may optionally include a system memory 52 for alternative storage of data. The game network 50 can include instructions for playing games, such as progressive jackpots that are contributed to by all or some of the gaming terminals 10 in the network 50. The gaming terminal 10 often has multiple serial ports, each port dedicated to providing data to a specific host computer system that performs a specific function (e.g., account system, player-tracking system, progressive game control system, etc.). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 50). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 50.

The gaming terminal 10 and associated game control network 50 is capable of executing wagering games on or through a controller 60. Controller 60, as used herein, comprises any combination of hardware, software, and/or firmware that may be disposed or resident inside and/or outside of a gaming terminal 10 or like machine which may communicate with and/or control the transfer of data between the gaming terminal and a bus, another computer, processor, or device, and/or a service and/or a network. The network may include, but is not limited to a peer-to-peer, client/server, master/slave, star network, ring network, bus network, or other network architecture wherein at least one processing device (e.g., computer) is linked to at least one other processing device. The controller 60 may comprise the I/O circuits 35*b* and the CPU 30. In other embodiments, the CPU 30 may be housed outside of the controller 60, and a different processor may be housed within the controller 60. The controller 60, as used herein, may comprise one or more controllers. In one implementation, each gaming terminal 10 comprises, or is connected to, a controller 60, enabling each gaming terminal 10 to transmit and/or receive signals, preferably both, in a peer-to-peer arrangement. In another example, the controller 60 may be adapted to facilitate communication and/or data transfer for one or more gaming terminals 10 in a client/server or centralized arrangement. In one aspect, shown in FIG. 2, the controller 60 may connect the gaming terminal 10 via a conventional I/O port and communication path (e.g. serial, parallel, IR, RC, 10 bT, etc.) to the game control network 50, which may include, for example, other gaming terminals connected together in the game control network 50.

Figure 3:
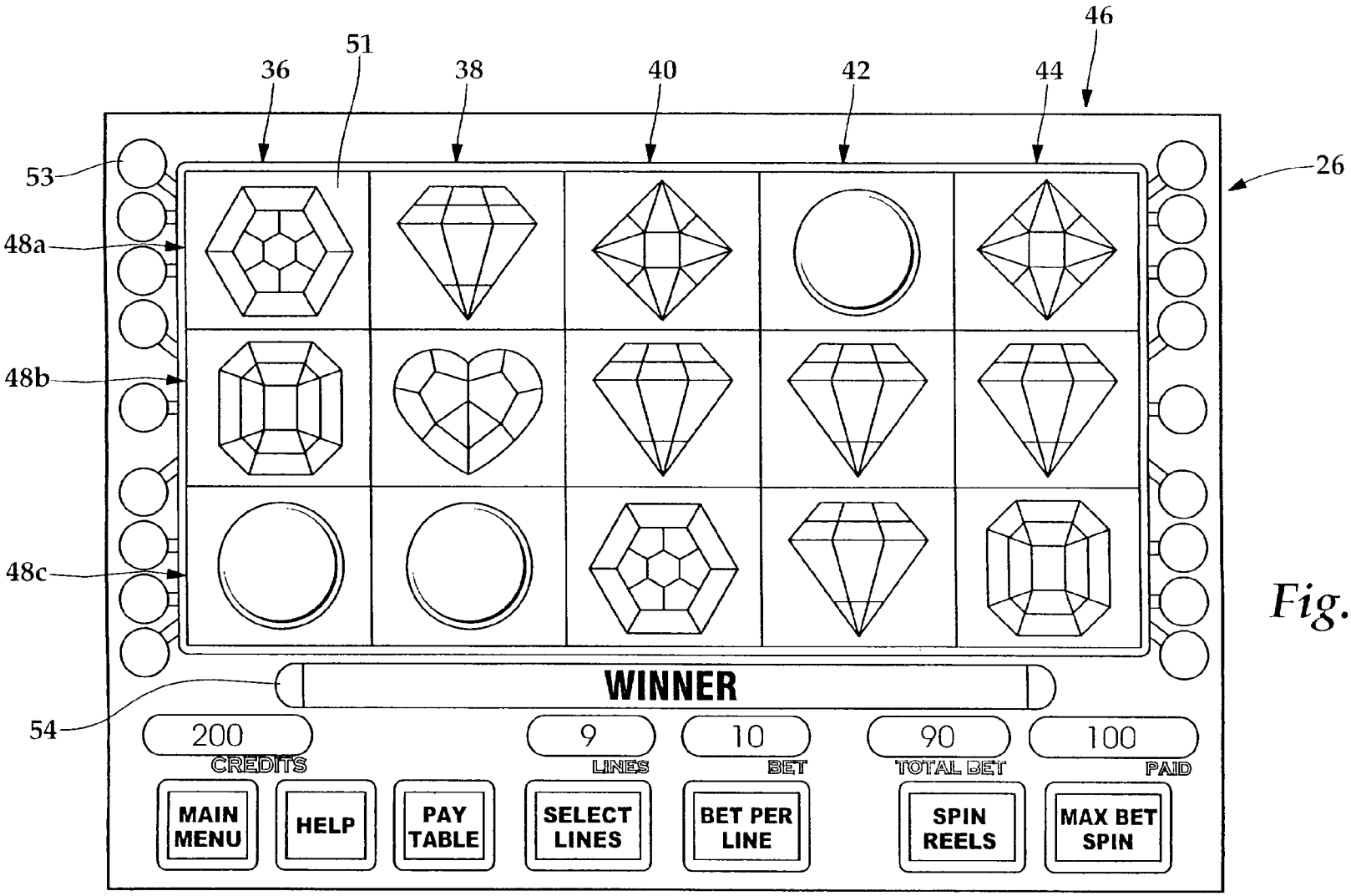
FIG. 3 illustrates an initial screen of a wagering game of the gaming terminal of FIG. 1.

Turning now to FIG. 3, the main display 26 of one embodiment of the present invention is shown in more detail. In this embodiment, the basic game is a slot machine game, with symbols on five different reels 36, 38, 40, 42, 44. The reels 36-44 may be either traditional mechanical reels or they may be computer-generated images of reels, with each reel composed of a plurality of symbols. The symbols on the reels 36-44 fill an array 46 having three rows 48*a*-48*c* and columns of the five reels 38-44 made of individual cells 50. Pay line indicators 53 indicate a randomly selected outcome for each pay line, which is the combination of symbols on the reels 36-44. Thereafter, an outcome indicator 54 indicates whether the outcome has resulted in a payout, a progressive jackpot, a bonus game, or whether it resulted in no reward at all. While multiple pay lines 53 are shown, a gaming terminal 10 with a single pay line will also work with the present invention.

In the present example, the wagering game follows a jewel theme, where the symbols represent different jewels and shapes. Various combinations of the symbols can result in prizes, including monetary and non-monetary prizes. The non-monetary prizes include free spins, multipliers, entry into a bonus game, entry into a progressive game, etc.

Figure 4:
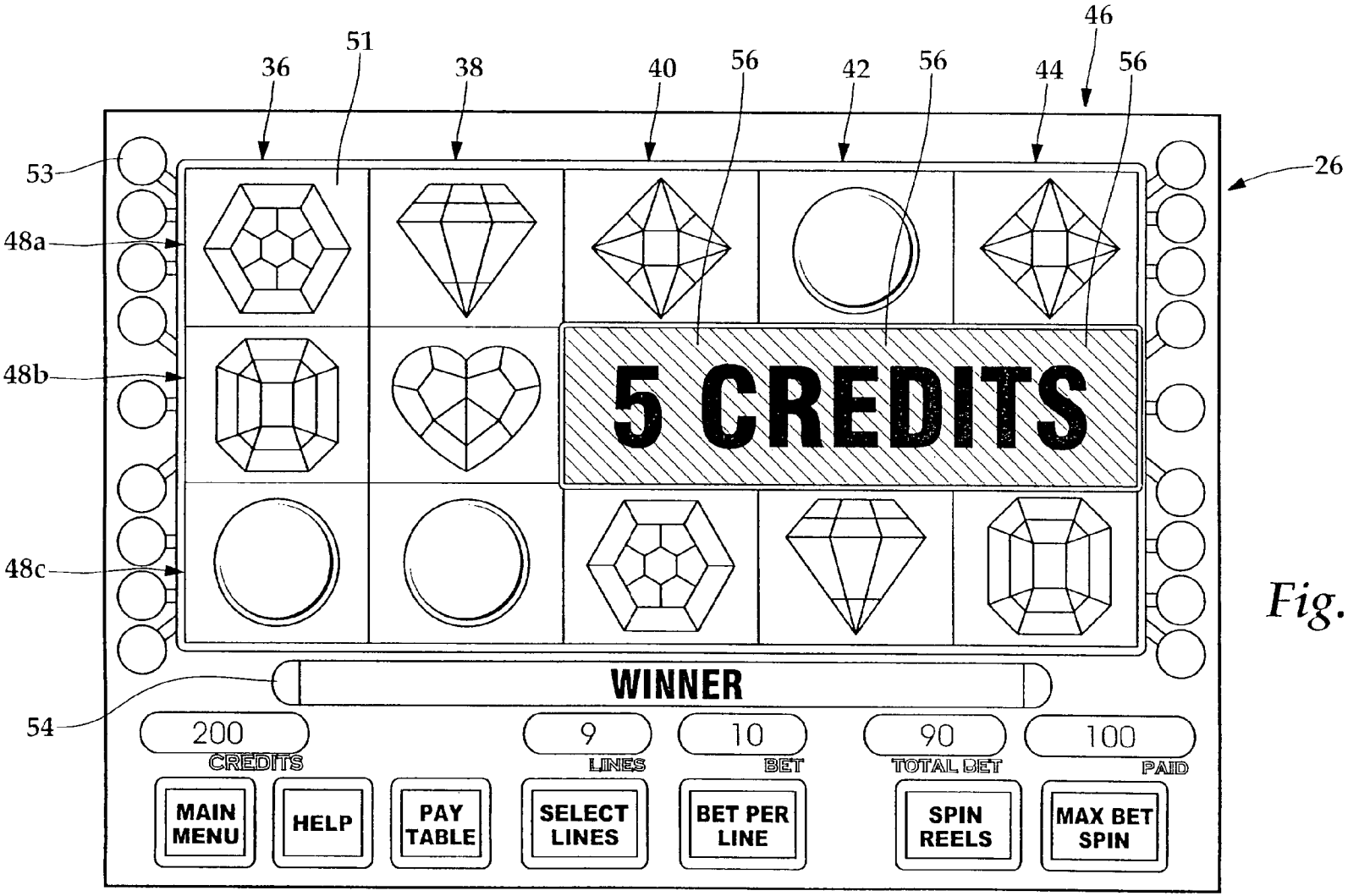
FIG. 4 illustrates a subsequent screen of the wagering game of the gaming terminal of FIG. 1.

In this particular embodiment, a particular combination of symbols on a paid pay line is a winning combination. In this embodiment, the combination of three matching symbols in the second row 48*b* is a winning combination. As shown in FIG. 4, once a winning combination is achieved, the player is awarded a prize, in this instance, 5 credits. Also, a background of each winning cell 56—the cells including the symbols from the winning combination—is modified. In some embodiments, the modification may cause the background to become shaded. In other embodiments, the background may be turned a different color, such as gold, silver, and/or bronze. While the background is modified (which may be during the present wagering game or subsequent wagering games), an event occurs that alters the game for the player. Some of these alterations will be described in reference to the various figures below.

Figure 5:
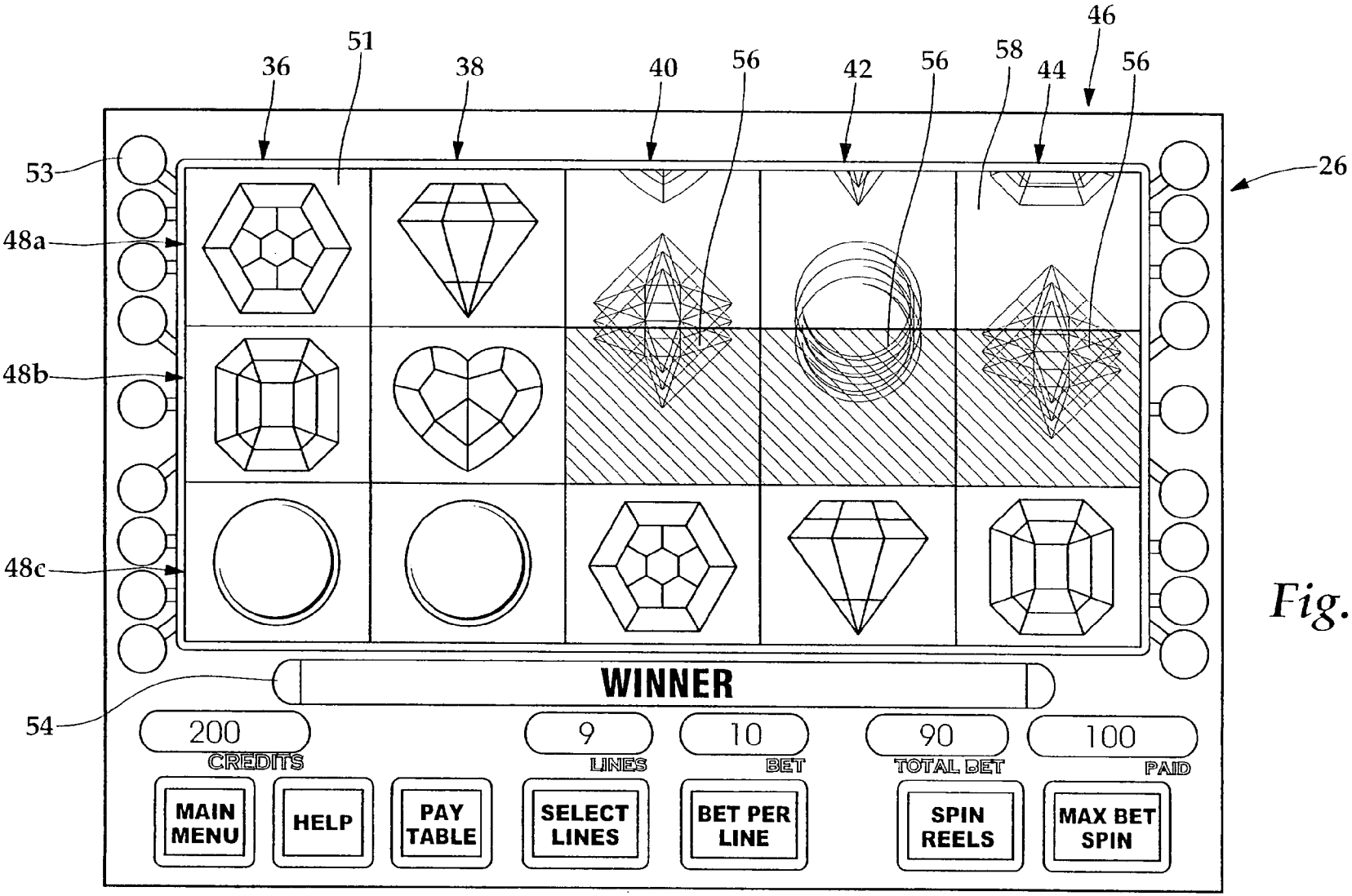
FIG. 5 illustrates another embodiment of a wagering game of the gaming terminal of FIG. 1.

FIG. 5 illustrates a cascading element feature. As illustrated in FIGS. 3 and 4, the winning combination occurred in the second row 48*b* and the background of the winning cells 56 have been modified, in this case, shaded. Once the cells 56 have been shaded, the winning symbols disappear, and the symbols above the winning combination of symbols cascade down to fill the positions vacated by the winning symbols. To the extent that cascading symbols leave any empty cells 58 at the top of the array 46, the empty positions are filled with new randomly selected symbols that drop into the array. The new symbol combinations may be such that new winning combinations are achieved. If the new combinations create winning combinations, the player is awarded the winning award associated with the new winning combination, the background of those cells will become shaded (if not already shaded), and the symbols will disappear, causing other symbols to cascade. This continues until no more winning combinations are achieved.

In a similar embodiment, the player may be able to switch two symbols in the array in order to create a winning combination. In such an embodiment, the background of those cells would become modified, the winning symbols would disappear, and the other symbols would cascade into the shaded cells. The swapping of symbols and cascading would continue until either the background of all of the cells in the entire array 46 were modified or until no more winning combinations could be created. If the entire array 46 was modified, the player could win a progressive award, an extra award such as a free spin, or be entered into a bonus game.

Similarly, in another cascading embodiment, should a player either achieve four symbols in a pay line or switch two symbols in the array to create four of the same symbols in a pay line, all but the switched symbol disappears, causing more cascading. The switched symbol does not disappear, but becomes an exploding symbol of its type. During subsequent games, after other switches, or after a cascade, if the exploding symbol is matched with two or more other symbols of its original type, instead of merely erasing the winning symbols in the pay line, the exploding symbol explodes, destroying all the adjacent symbols (or a predetermined number of symbols), granting greater credit amounts. In this embodiment, the background of all of the cells containing the symbols that are destroyed would become modified. In other embodiments, only the backgrounds of the cells involved in the winning combination would become modified.

In yet another cascading embodiment, if a player achieves or switches a symbol to create five symbols in a pay line, the switched symbol becomes a super-wild symbol. When this symbol is then used to create three or more of a kind, it causes all of the symbols of that type to disappear from the screen. The player wins credits or other awards for each of the symbols that are erased, and the background of the cells containing these symbols may all become modified.

A player may also win additional credits by performing a switch that causes two sets of three or more matches. All of the backgrounds of the cells would also become modified.

These embodiments may be performed during a switch or may be used in subsequent spins. Also, each of these embodiments may cause new symbols to cascade down into the empty cells as described above.

In some embodiments, the modified background may cause the new symbols that fall into the modified cells (whether through the cascading feature described above or in a subsequent spin) to morph into a different symbol.

Figure 6:
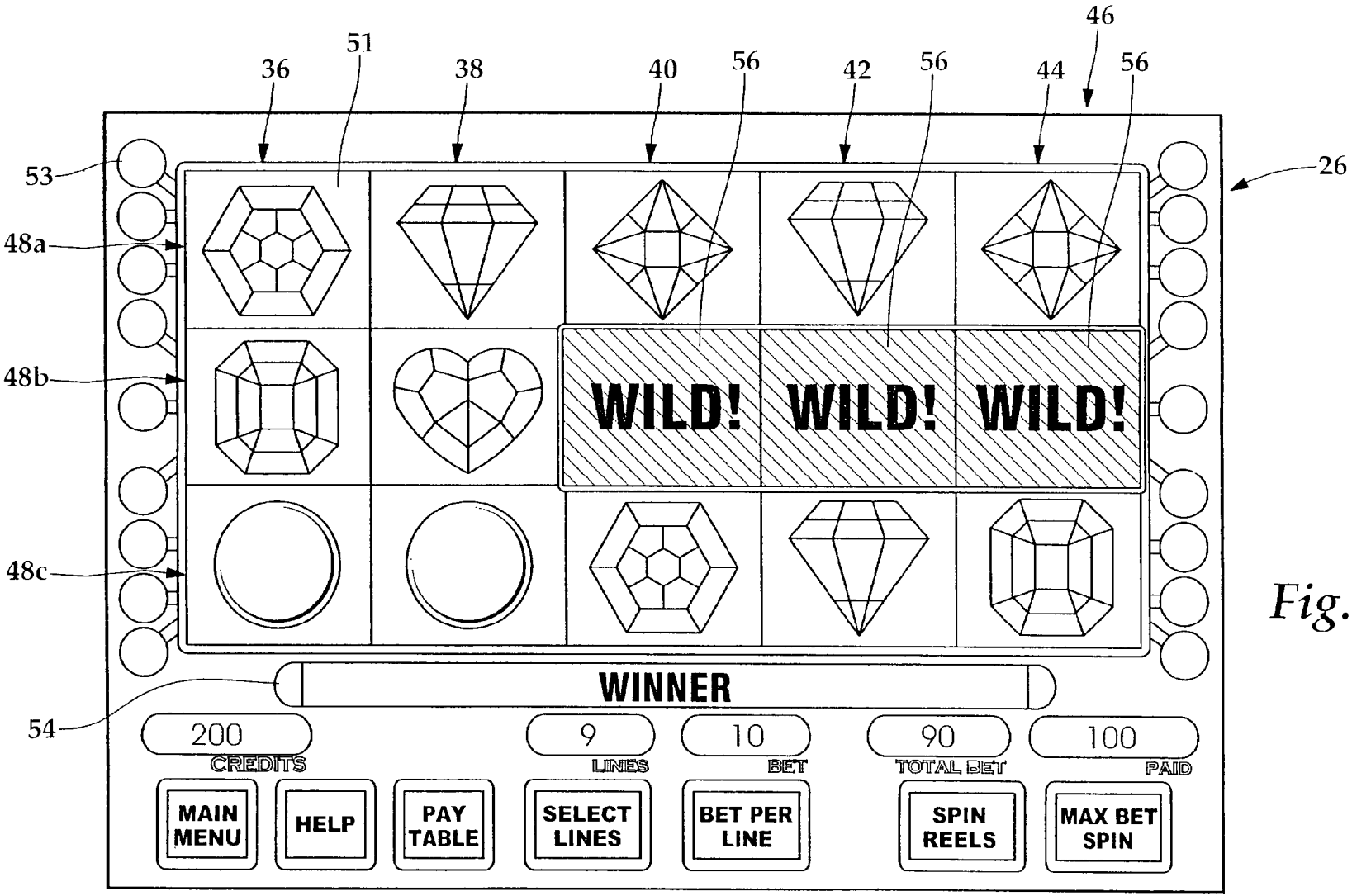
FIG. 6 illustrates another embodiment of a wagering game of the gaming terminal of FIG. 1.

In one of these embodiments, illustrated in FIG. 6, after a winning combination causes the background to be modified, the next time a symbol in a winning combination lands into a modified cell, the symbols in the winning cells 56 morph into wild symbols. In the illustrated embodiment, the change to "wild" causes a winning combination in the second-to-last reel 42. The player would then be awarded the credit amount for that winning combination. Also, the backgrounds of the cells in this winning combination are also modified. If the game is a cascade game, the symbols would disappear, causing other symbols to land in the cells 56.

Figure 7:
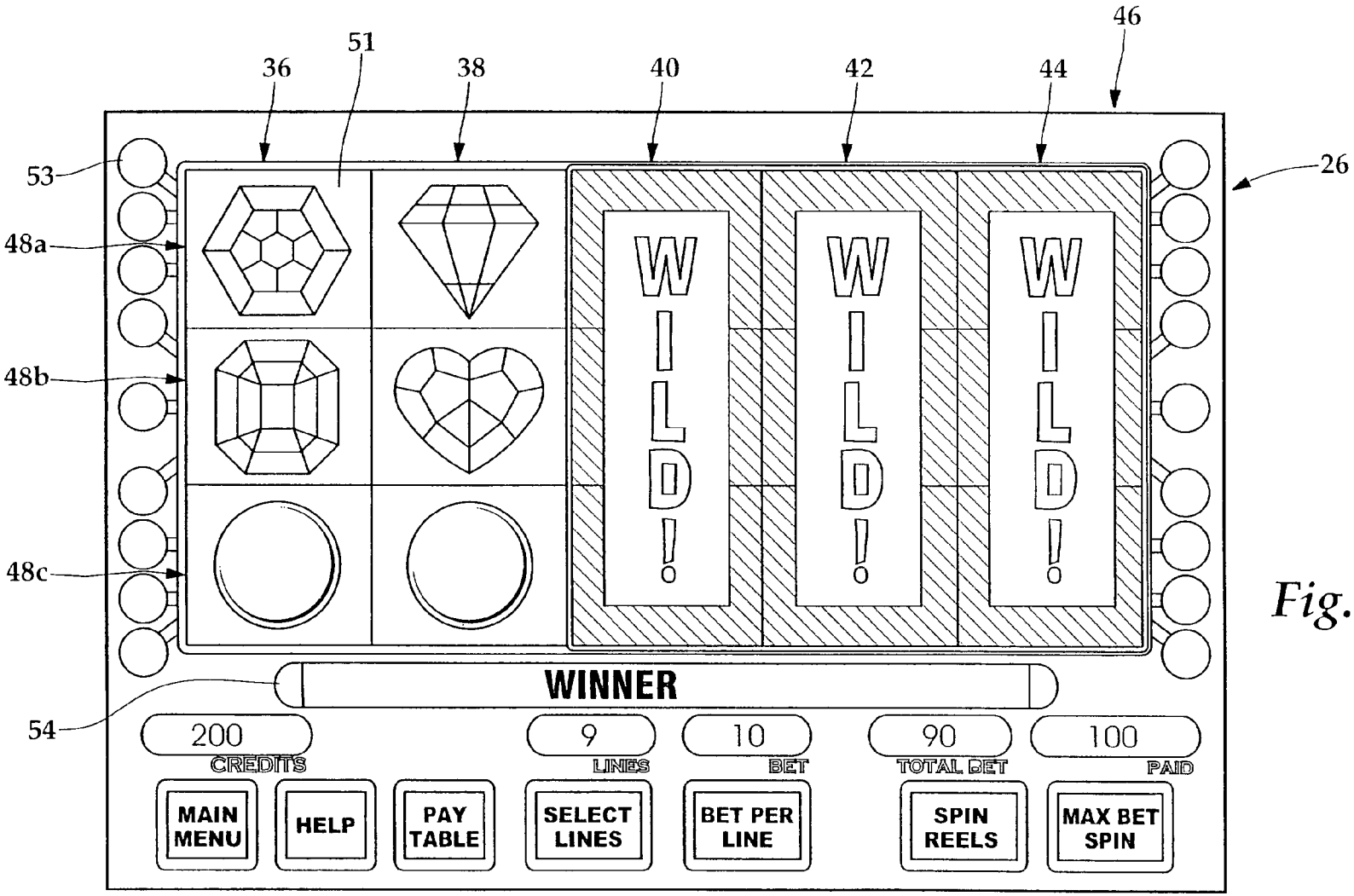
FIG. 7 illustrates yet another embodiment of a wagering game of the gaming terminal of FIG. 1.

Turning now to FIG. 7, an alternative to FIG. 6 is shown. In this embodiment, a winning combination causes the background to become modified as described above. Once another winning symbol lands in a shaded cell, the new winning symbol morphs into an expanding "wild" symbol (in this example, all three symbols were in shaded symbols), taking up each of the entire reels 40-44. Because each of the reels 40-44 is a wild, there are many new winning combinations to be awarded to the player, e.g., the third row 48*c* has three circles in a row. In some embodiments, the expanding "wild" symbols may only last for a single spin or single cascade, while in others, the "wild" symbol remains for a predetermined amount of time, until all the symbols are gone or until there are no more new winning combinations. In some embodiments, only a "wild" symbol that is part of a winning combination morphs into an expanding wild and the rest of the symbols turn into single "wild" symbols.

In another embodiment, a winning symbol that lands in a previously shaded cell could morph into a "scatter" symbol, meaning that it pays whenever it is on the display, even if it is not directly on the pay line.

Figure 8:
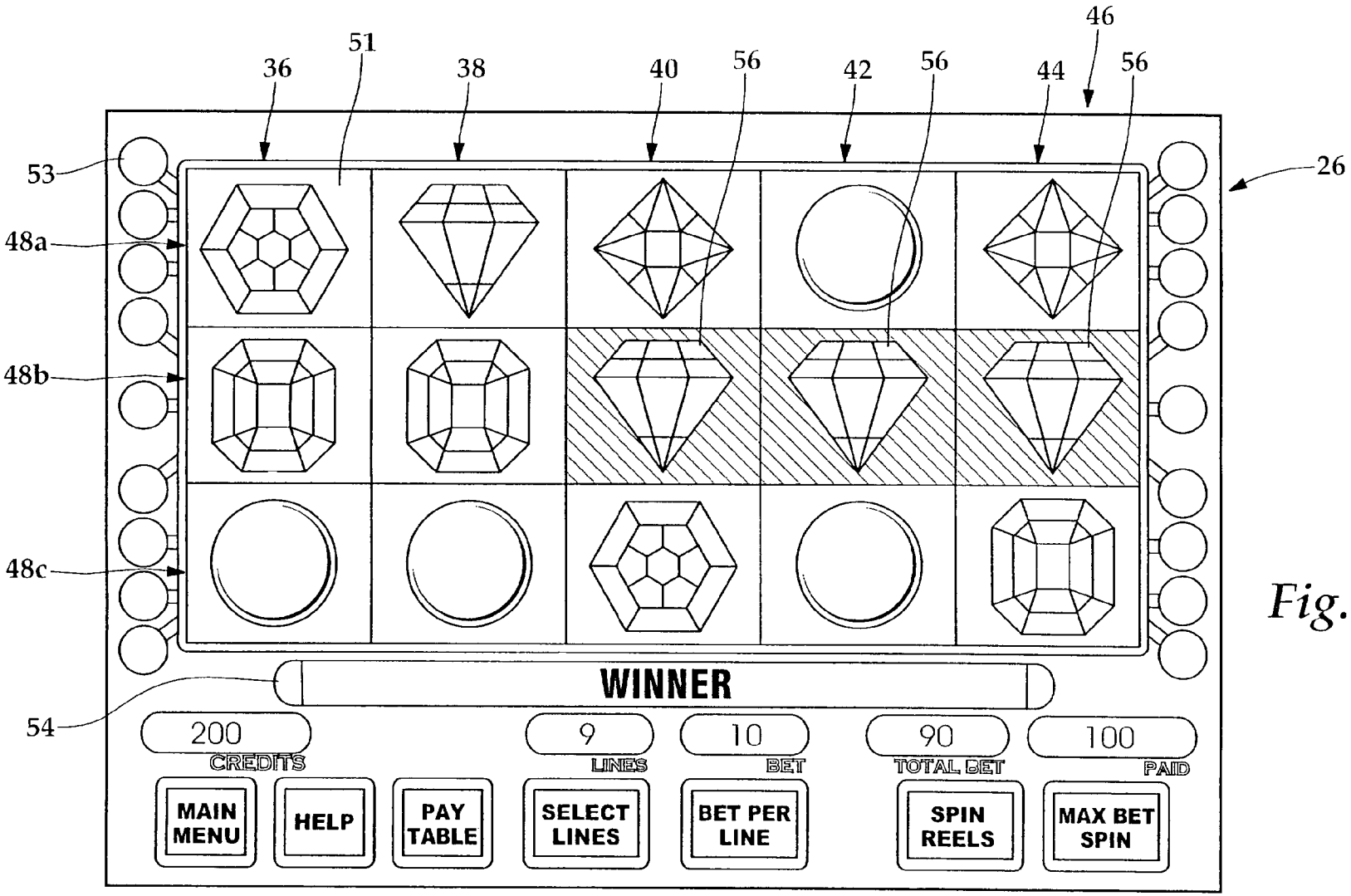
FIG. 8 illustrates yet another embodiment of a wagering game of the gaming terminal of FIG. 1.
Figure 9:
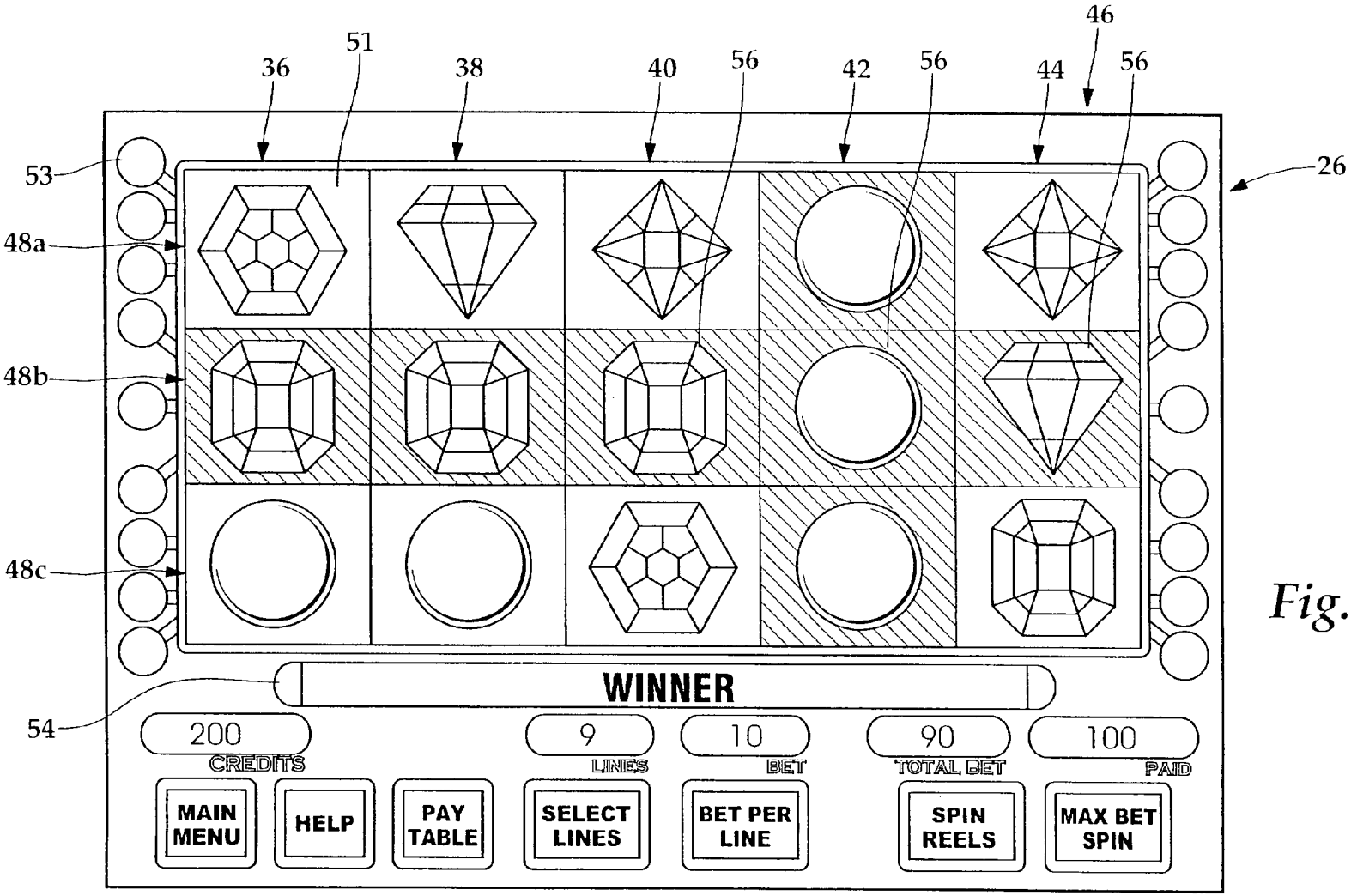
FIG. 9 illustrates another screen of the wagering game of FIG. 8.

Turning now to FIGS. 8 and 9, another embodiment utilizing the morphing feature is shown. In this embodiment, after a background has been shaded, the symbols in the original winning cells 56 (shown in FIG. 8) morph into other winning symbols to cause more winning combinations (shown in FIG. 9). As illustrated, the symbols change into different gems to cause two new winning combinations, one from reel 42 and one across the second row 48*b*. The player is then awarded the amounts for all of the winning combinations.

As stated above, the new winning combinations can be achieved during a cascade event or during a subsequent spin.

Figure 10:
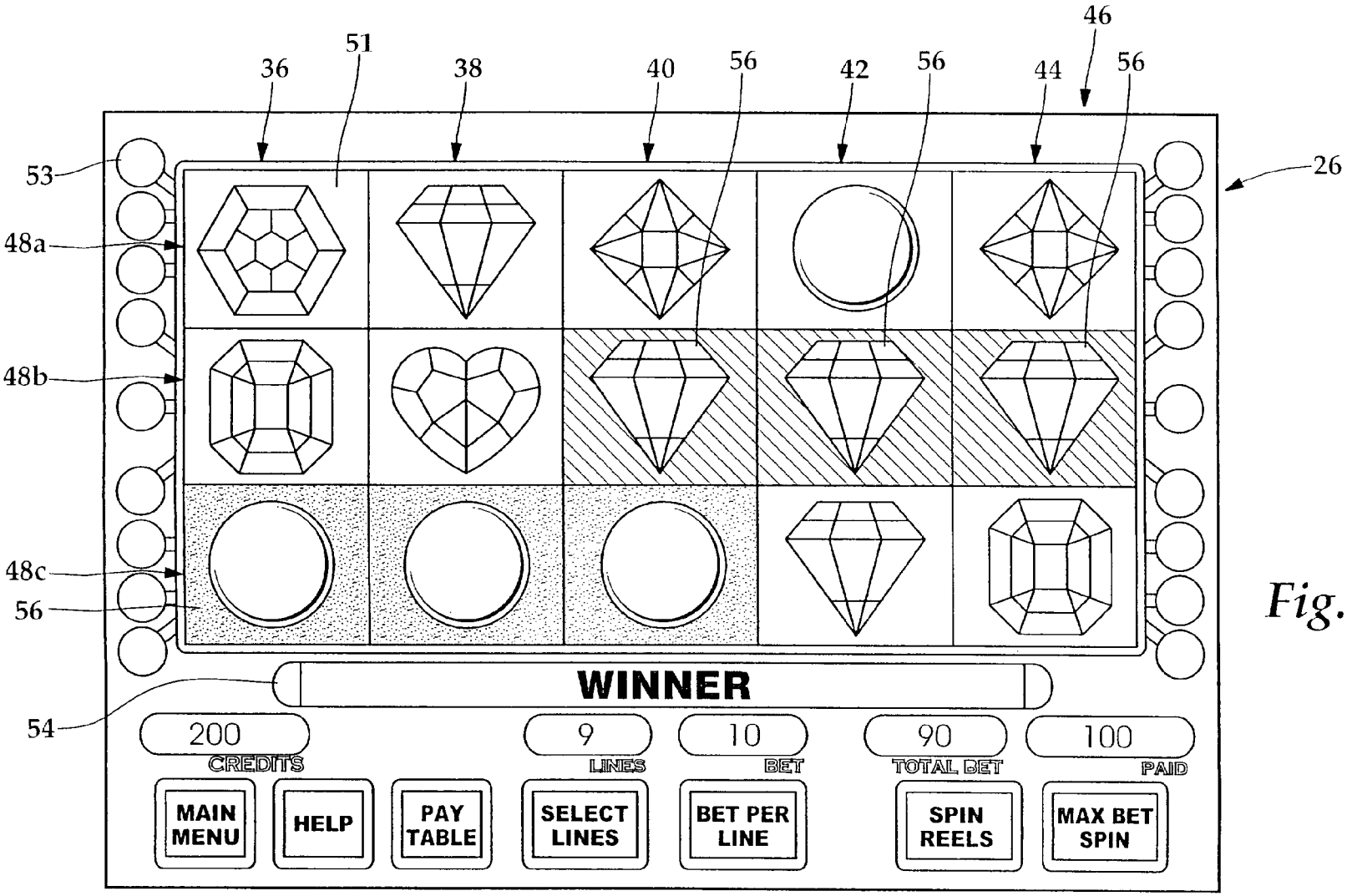
FIG. 10 illustrates yet another embodiment of a wagering game of the gaming terminal of FIG. 1.

Turning now to FIG. 10, another embodiment of the present invention will be described. In this embodiment, the winning cells 56 are modified in different ways. In the illustrated embodiment, the winning cells 56 are shaded in different ways. In other embodiments, the winning cells could be colored different colors or otherwise modified in differing ways. In the illustrated embodiment, there are two winning combinations, one in the second row 48*b* and one in the third row 48*c*. The three winning cells in the second row 48*b* are shaded one way, while the three winning cells in the third row 48*c* are shaded another way. In this embodiment, the shading is dependent upon the value of the winning combination, e.g., the more credits won, the darker the shading. In other embodiments, the shading may be randomly determined or be based upon amounts wagered. In embodiments in which the shading remains for multiple spins, the shading may change based upon how many times a cell is a part of a winning combination. For example, the first time a cell is part of a winning combination, the background is colored bronze. The next time that cell is part of a winning combination, the background turns to silver, and the third time it turns to gold. The different backgrounds could have differing awards. A bronze background may increase a player's winnings by one multiplier while the silver and gold increase a player's winnings by a different multiplier. Alternatively, the player could win a set number of credit amounts for winning combinations in a bronze cell and more credits for winning combinations in a silver or gold cell. In games having multiple progressive jackpots, modifying all of the cells one way may result in the player being awarded one of the progressive jackpots. If all of the cells are colored, but some are colored bronze, and others silver and gold, the player may be awarded either the highest progressive jackpot corresponding to a color of a cell, the lowest progressive jackpot corresponding to a color of a cell, or the progressive jackpot that corresponds to the greatest number of colored cells.

In any of the embodiments described above, the shading or coloring may not stay shaded for subsequent spins. Alternatively, the shading or coloring may persist for a set number of spins or until a player leaves a particular machine. Should the shading or coloring persist for multiple spins, the player would be awarded an extra prize if he or she has all of the cells 56 shaded or colored. The extra prize may be a progressive jackpot, set number of credits, and/or entry to a bonus game.

In other embodiments, the backgrounds may be able to be saved, and the next time the player plays the game, the same shading will appear. In these embodiments, as shown in FIG. 2, the CPU 30 is also used with the information reader 24 to restore saved coloring of the array. For example, in one embodiment, the information reader 24 is adapted to receive and distribute tickets. The tickets each include a unique identifier. The unique identifier links the ticket to a file contained within the local memory 32 or a system memory 52 located in the game network 50. The file includes the color of the various cells in the array that are being stored from a previous game. Monetary awards include game credits or money, while the non-monetary awards can be free plays (e.g., free spins), multipliers, or access to bonus and/or progressive games.

When a player inserts a ticket into the information reader 24, the CPU 30 obtains the unique identifier and causes the appropriate memory 32, 52 to be searched, and the file containing the unique identifier matching the identifier on the ticket is retrieved. The coloring (or shading) of cells or other information contained in this file are then transmitted to the gaming terminal 10, and the player regains any shading or coloring that were saved during a previous game. This allows the player to keep colored cells even after a particular gaming session ends, which increases player commitment to a game and decreases vulturing (and possibly even ends it).

In other embodiments, the information reader 24 may include a card reader, and the unique identifier provided at the gaming terminal 10 may be stored on a personal identification card, such as one described above. Or, the gaming terminal 10 includes a radio frequency identification device (RFID) transceiver or receiver so that an RFID transponder held by the player can be used to provide the unique identifier of the player at the gaming terminal 10 without the need to insert a card into the gaming terminal 10. RFID components can be those available from Pacific Northwest National Laboratory (under the United States Department of Energy) of Richland, Wash.

In other embodiments, the information reader 24 may include a biometric reader, such as a finger, hand, or retina scanner, and the unique identifier may be the scanned biometric information. Additional information regarding biometric scanning, such as fingerprint scanning or hand geometry scanning, is available from International Biometric Group LLC of New York, N.Y. Other biometric identification techniques can be used as well for providing a unique identifier of the player. For example, a microphone can be used in a biometric identification device on the gaming terminal so that the player can be recognized using a voice recognition system.

In other embodiments, the player may simply have to enter in a unique identification code and password into the gaming terminal 10. In these embodiments, the player would not have to insert a physical object (such as a card or ticket) into the gaming terminal, but would instead use the information reader as an input device, such as a keyboard.

In summary, there are many techniques in which to provide a unique identifier for the player so that the modification of cells accumulated by the player during one wagering session can be stored in either the system or local memory 52, 32, thereby allowing the player to subsequently access that modified array at the same gaming terminal 10 or a different gaming terminal within the network 50.

In another embodiment of the present invention, a winning combination causes the background of the winning cells 56 to become modified. Later, whether through a cascade or a subsequent spin, if a new winning combination is achieved with a symbol landing in a previously modified cell, the player receives less of a payout then if all of the symbols were in unmodified cells. For example, a combination of three "diamond" symbols may result in a payout of 75 credits if none of the "diamond" symbols are in a previously shaded cell. If one of the "diamond" symbols is in a previously shaded cell, the payout may be reduced to 60 credits.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of playing a wagering game, the method comprising:

conducting the wagering game via a gaming system;

displaying, via at least one display device in communication with one or more processors, a randomly generated outcome comprising a plurality of symbols in a symbol array, each of the plurality of symbols contained in a cell of the array;

in response to the outcome comprising a designated winning combination of one or more symbols, awarding a player a winning award and modifying a background of each cell containing a symbol in the winning combination, to create at least one modified cell;

generating a new outcome, via the one or more processors, by i) replacing each symbol contained in the at least one modified cell with a replacement symbol, and ii) altering at least one replacement symbol contained in the at least one modified cell;

displaying the new outcome via the at least one display device; and evaluating the new outcome, including the at least one altered replacement symbol, for a new winning combination via the one or more processors.

2. The method of claim 1, wherein the altering comprises morphing the at least one replacement symbol into a different symbol.

3. The method of claim 2, wherein the morphing further comprises causing an entire row of symbols in the array to morph, the entire row including the at least one replacement symbol.

4. The method of claim 2, wherein the morphing comprises causing the at least one replacement symbol to morph into another symbol that creates a new winning combination.

5. The method of claim 1, wherein the altering comprises causing the at least one replacement symbol to be a "scatter" symbol.

6. The method of claim 1, wherein the altering comprises replacing the at least one replacement symbol with a symbol from an adjacent cell.

7. A method of playing a wagering game, the method comprising:

conducting the wagering game at a gaming terminal;

displaying, via at least one display device in communication with one or more processors, a randomly generated outcome comprising a plurality of symbols contained in respective cells of a symbol array;

in response to at least one symbol contained in a cell of the array comprising a first winning combination, awarding a player a winning award and modifying a background of one or more of the cells containing the first winning combination to create one or more modified cells;

generating a new outcome, via the one or more processors, by i) replacing each symbol contained in the one or more modified cells with a replacement symbol, and ii) altering at least one of the replacement symbols contained in the one or more modified cells;

displaying, via the at least one display device, the new outcome during a predetermined period while maintaining the one or more modified cells;

evaluating the new outcome, and if one or more symbols of the new outcome of symbols comprises a second winning combination, awarding the player a winning award and modifying a background of one or more cells containing the second winning combination to create one or more additional modified cells.

8. The method of claim 7, wherein the one or more additional modified cells created in response to containing the second winning combination were previously modified in response to containing the first winning combination.

9. The method of claim 7, wherein the first and second winning combinations are each from a plurality of possible winning combinations, and the symbols in the modified cells are altered differently depending on which winning combination created the modified cells.

10. A gaming system for playing a wagering game, the system comprising:

at least one input device for receiving inputs from a player during the wagering game, the inputs including a wager amount;

at least one display device for displaying a plurality of symbols of the wagering game in response to receiving the wager amount from the player, each of the plurality of symbols being contained in a cell of an array; and a controller operating with the at least one input device and the at least one input device to:

randomly generate an outcome by varying the symbols contained in the cells of the array;

evaluate the outcome for a designated winning combination of one or more symbols;

in response to the designated winning combination occurring in the array, award a player an award and modify one or more cells containing the symbols of the winning combination to create at least one modified cell;

randomly generating a new outcome, via the one or more processors, by i) replacing each symbol contained in the one or more modified cells with a replacement symbol, and ii) altering one or more replacement symbols of the new outcome contained in the one or more modified cells;

displaying the new outcome via the at least one display device; and evaluating the new outcome for a new winning combination.

11. The gaming system of claim 10, wherein the altering comprises morphing the one or more replacement symbols of the new outcome into a different symbol to create a possibility of obtaining a new winning combination.

12. The gaming system of claim 11, wherein the one or more replacement symbols of the new outcome are morphed into a "wild" symbol.

13. The gaming system of claim 11, wherein one of an entire row and an entire column, including the one or more replacement symbols of the new outcome are morphed into "wild" symbols.

14. The gaming system of claim 11, wherein the one or more replacement symbols of the new outcome are morphed into another symbol that creates a new winning combination.

15. The gaming system of claim 11, wherein one or more replacement symbols of the new outcome are morphed into a scatter symbol.

16. The gaming terminal of system 10, wherein one or more replacement symbols of the new outcome was previously a symbol contained in a cell adjacent to a modified cell.

17. A method of playing a wagering game, the method comprising:

providing a plurality of possible winning outcomes with corresponding respective standard payouts;

displaying, via at least one display device, an outcome comprising a plurality of randomly selected symbols contained in respective cells of an array;

in response to the displayed outcome including a first winning outcome of the plurality of possible winning outcomes, awarding a player the standard payout corresponding to the first winning outcome, and modifying backgrounds of the cells containing the first winning outcome to create modified cells;

generating a new outcome, via one or more processors, by i) replacing each symbol contained in the modified cells by cascading a replacement symbol from an adjacent cell into each of the modified cells; and ii) altering at least one replacement symbol in the modified cells;

displaying the new outcome via the at least one display device; and in response to the cascading resulting in a second winning outcome being displayed and the second winning outcome including one or more of the replacement symbols, awarding the player an enhanced payout with a higher value than the standard payout corresponding to the second winning outcome.

18. The method of claim 17, further comprising:

modifying a background of at least one of the cells containing the second winning outcome to create at least one additional modified cell;

vacating the at least one additional modified cell by removing the symbols included in the second winning outcome;

cascading a replacement symbol from an adjacent cell into each of the at least one additional modified cells; and in response to the cascading resulting in a third winning outcome being displayed and the third winning outcome including one or more of the replacement symbols, awarding the player an enhanced payout with a higher value than the standard payout corresponding to the third winning outcome.

19. The method of claim 18, wherein, in response to a portion of the second winning outcome being displayed in the at least one additional modified cell, further modifying the background of the modified cells.

20. The method of claim 19, further comprising, in response to the cascade resulting in a portion of the third winning outcome being contained within one or more of the further modified cells, enhancing the third winning outcome more than the enhancement of the second winning outcome.

* * * * *